United States Patent [19]

White

[11] Patent Number: 4,790,774

[45] Date of Patent: Dec. 13, 1988

[54] MOBILE ANTENNA MOUNTING

[75] Inventor: Wayne White, Hillside, Ill.

[73] Assignee: Whisco Component Engineering, Inc., Glendale Heights, Ill.

[21] Appl. No.: 126,508

[22] Filed: Nov. 30, 1987

[51] Int. Cl.[4] ..... H01R 13/74

[52] U.S. Cl. ..... 439/551; 439/559; 439/916

[58] Field of Search ..... 439/34, 551, 559, 881, 439/916

[56] References Cited

U.S. PATENT DOCUMENTS

| | | | |
|---|---|---|---|
| 3,750,090 | 7/1973 | Teman | 439/551 |
| 4,066,324 | 1/1978 | Stephens | 439/916 X |
| 4,090,030 | 5/1978 | Lagasse | 439/559 X |
| 4,096,352 | 6/1978 | Von Zweck | 439/559 X |

FOREIGN PATENT DOCUMENTS

| | | | |
|---|---|---|---|
| 2250259 | 5/1975 | France | 439/551 |

*Primary Examiner*—Eugene F. Desmond

*Attorney, Agent, or Firm*—Robert F. Van Epps

[57] ABSTRACT

A low profile mobile antenna mounting of a simplified construction having a stamped sheet metal mounting bracket adapted for use with multiple size openings in the vehicle body.

3 Claims, 1 Drawing Sheet

MOBILE ANTENNA MOUNTING

BACKGROUND OF THE INVENTION

1. Field of the Invention

The present invention relates generally to mobile antenna mountings and more particularly to a simplified and economical structure for mounting a mobile antenna to a vehicle.

2. Description of the Prior Art

Prior to the present invention a variety of structures have been devised for mounting mobile antennas to vehicles. Representative of such structures are U.S. Pat. Nos. 3,944,722 dated Mar. 16, 1976 to Larsen and 4,136,986 dated Jan. 30, 1979 to Grashow et al. Another antenna mounting structure which has been widely used in the industry are the TAB and TAD series antenna mounts manufactured by Motorola Inc. of Schaumburg, Ill.

The antenna mounting structures of the prior art generally require the use of a multiplicity of machined parts which are expensive to manufacture and relatively complex to assemble. They also are designed such as to require a single specific size hole through the body of the vehicle; generally either ⅜ inch or ¾ inch, and are not adaptable for use with any other size.

OBJECTIVES AND SUMMARY OF THE INVENTION

From the foregoing discussion it will be understood that among the various objectives of the present invention are included the following:

to provide a new and improved mobile antenna mounting structure;

to provide an apparatus of the above-described character which is of a simplified and economical construction;

to provide an apparatus of the above-described character which is easy to assemble; and to provide an apparatus of the above-described character adaptable for use with more than a single size mounting hole.

These and other objectives of the present invention are efficiently achieved by providing a stamped sheet metal mounting bracket adapted to receive an antenna connector assembly and which, when tilted at a slight angle may be inserted into a ¾ inch hole in the vehicle from the outside. When access is available from the inside a ⅜ inch hole may be used. An "O" ring is placed over the connector assembly externally of the vehicle and a retaining nut is threaded onto the connector assembly to compress the "O" ring and to make a waterproof connection with the exterior surface of the vehicle. Serrations may be provided in the upper edges of the connector assembly to make electrical contact with the inside of the vehicle body.

The foregoing as well as other objects, features and advantages of the present invention will become better understood from the following detailed description taken in conjunction with the various views of the appended drawings.

DESCRIPTION OF PREFERRED EMBODIMENT

Figure 1:
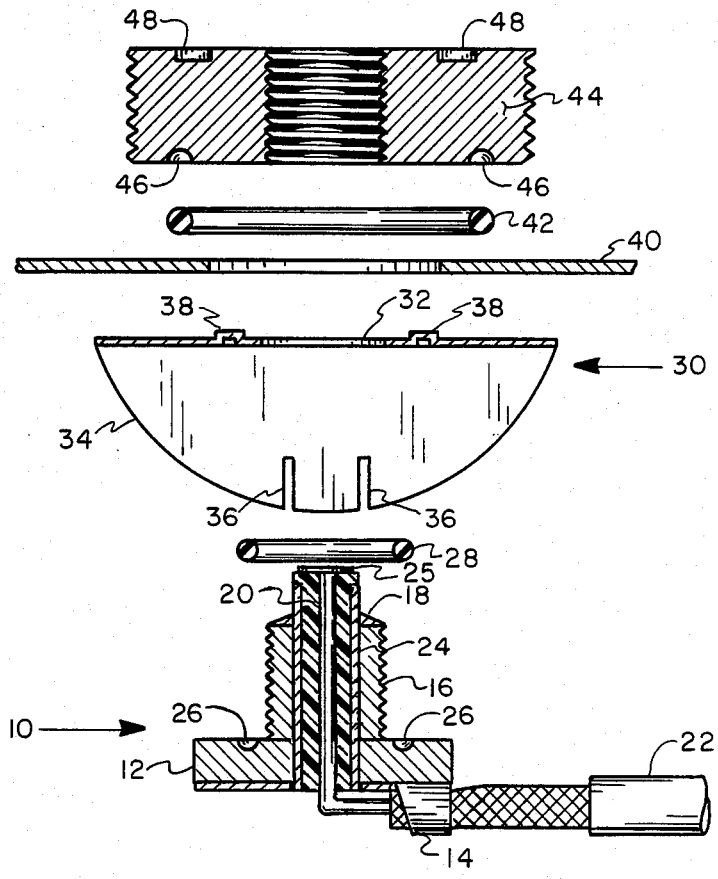
FIG. 1 is an exploded cross-section view of the apparatus of the present invention.

With reference now to FIG. 1 there is shown in exploded cross-section a mobile antenna mounting apparatus in accordance with the principles of the present invention. A connector assembly 10 is formed of a bushing 12 having a threaded lug 16 extending upwardly and forms a ground contact 18. The shield of coaxial cable 22 is coupled to a grounding lug 14. Disposed longitudinally within the lug 16 is the antenna lead 20 which extends from coaxial cable 22 through insulation 24 to contact 25. The upper surface of bushing 12 is provided with an annular recess 26 adapted to receive a first "O" ring 28.

A mounting bracket 30 in cross-section is generally of a semi-oval shape having a substantially flat upper surface with an opening 32 adapted to receive the lug 16 of the connector assembly 10. The bracket 30 has two spaced apart, substantially parallel downwardly extending semi-oval flanges 34 at least one of which is provided with inwardly extending locking tabs 36. Thus when the connector assembly 10 is inserted into the bracket 30 the locking tabs 36 grip the bushing 12 and hold the two together during final assembly. The upper surface of bracket 30 is also provided with centering tabs 38 spaced about the opening 32 at a first selected diameter, such as, for example, ⅜ inch. The overall width of the bracket 30 is in excess of a second selected diameter such as, for example, ¾ inch. Thus when the bracket 30 is tilted at an angle it may be inserted through and align with either size hole through the body 40 of the vehicle from the exterior.

When the mounting bracket 30 together with the connector assembly 10 is in place the lug 16 extends through to the exterior of the vehicle body 40. A second "O" ring 42 is placed over the lug 16 and a retaining nut 44 is threaded thereon. The retaining nut 44 is provided in the lower surface thereof with an annular recess 46 adapted to receive the second "O" ring 42. As the retaining nut 44 is tightened the second "O" ring is compressed against the vehicle body 40 to form a weather tight seal and the outer portion of the retaining nut 44 contacts the outer surface of the vehicle body 40 to provide an electrical ground. The upper surface of the retaining nut 44 is provided with holes 48 for a spanner wrench or other tightening tool. The retaining nut 44 is also externally threaded to receive an antenna (not shown) of whatever type may be desired for the particular purpose.

Figure 2:
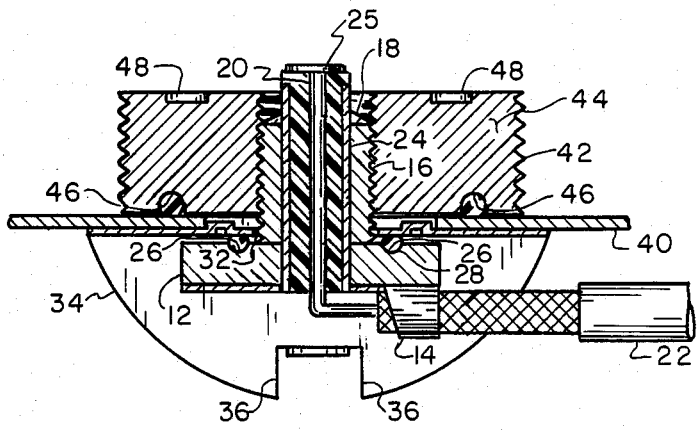
FIG. 2 is a cross-section view of the apparatus of FIG. 1 in its assembled state.

FIG. 2 is an illustration, partially in cross-section and partially in elevation of the apparatus of FIG. 1 in its fully assembled form. Elements common to those shown in FIG. 1 are identified by like reference characters. In actual practice, when properly seated the center contact 18 of the apparatus will extend approximately 5/16 inch from the outer surface of the body 40.

From the foregoing it will be understood that the applicant has provided a new and novel mobile antenna mounting apparatus whereby the objectives set forth hereinabove are efficiently met. Since certain changes in the above-described construction will occur to those skilled in the art without departure from the scope of the invention it is intended that all matter set forth herein or shown in the various views of the appended drawings shall be interpreted as illustrative and not in a limiting sense.

Having described what is new and novel and desired to secure by Letters Patent, What is claimed is:

1. Apparatus for mounting a mobile antenna through a hole in the body of a vehicle, said apparatus comprising a connector assembly including a bushing having a hollow, cylindrical, externally threaded lug extending outwardly from substantially the center of one surface, an electrical conductor extending longitudinally through and insulated from said threaded lug, and means for coupling the central wire of a co-axial cable to said electrical conductor and the shield of said co-axial cable to said bushing;

a mounting bracket having a substantially flat upper surface with a central aperture therein and two spaced apart downwardly extending semi-oval shaped flanges, said mounting bracket being adapted to receive said connector assembly between said flanges such that said threaded lug extends through the upper surface of said bracket; and a retaining nut internally threaded to engage said threaded lug and externally threaded to receive a mobile antenna such that when said threaded lug is inserted through the hole in the body of a vehicle the upper surface of said mounting bracket engages the interior surface of said vehicle body and said retaining nut engages the outside surface of said body.

2. Apparatus as set forth in claim 1 wherein said mounting bracket has a plurality of centering tabs extending upwardly of the upper surface thereof and spaced about said central aperture at a selected diameter with respect to the center of said aperture.

3. Apparatus as set forth in claim 1 further including an annular compressible sealing means disposed in the lower surface of said retaining nut to form a substantially moisture proof seal between said nut and said vehicle body.

* * * * *